US005893456A

United States Patent [19]

Bosmans

[11] Patent Number: 5,893,456

[45] Date of Patent: Apr. 13, 1999

[54] TYPING AND FASTENING DEVICE

[75] Inventor: Jan Bosmans, Antwerp, Belgium

[73] Assignee: Ghent Supply N.V., Eke, Belgium

[21] Appl. No.: 08/926,040

[22] Filed: Sep. 9, 1997

[51] Int. Cl.[6] ..... A44B 21/00

[52] U.S. Cl. ..... 206/338; 24/17 AP; 24/16 PB

[58] Field of Search ..... 206/338, 340, 206/345, 346; 24/17 AP, 16 PB

[56] References Cited

U.S. PATENT DOCUMENTS

| | | | |
|---|---|---|---|
| 2,648,879 | 8/1953 | Patterson | 24/16 PB |
| 2,943,371 | 7/1960 | Patterson | 24/16 PB |
| 3,673,639 | 7/1972 | Driscoll | 24/16 PB |

*Primary Examiner*—Jacob K. Ackun

*Attorney, Agent, or Firm*—Sughrue, Mion, Zinn, Macpeak & Seas, PLLC

[57] ABSTRACT

The one piece rubber tying and fastening device comprising an endless band with an outer face located between two lateral faces, a knob and a neck portion connecting the said knob to the outer face of the endless band, the said knob having a substantially circular face and two intermediate faces connecting the said circular face to the neck portion, while the neck portion has two opposite side faces connecting the outer face of the endless band to the intermediate faces of the knob, whereby the intermediate faces in the neighborhood of the neck portion and the two side faces of the neck portion have a minimum bend radius of 0.5 mm.

15 Claims, 3 Drawing Sheets

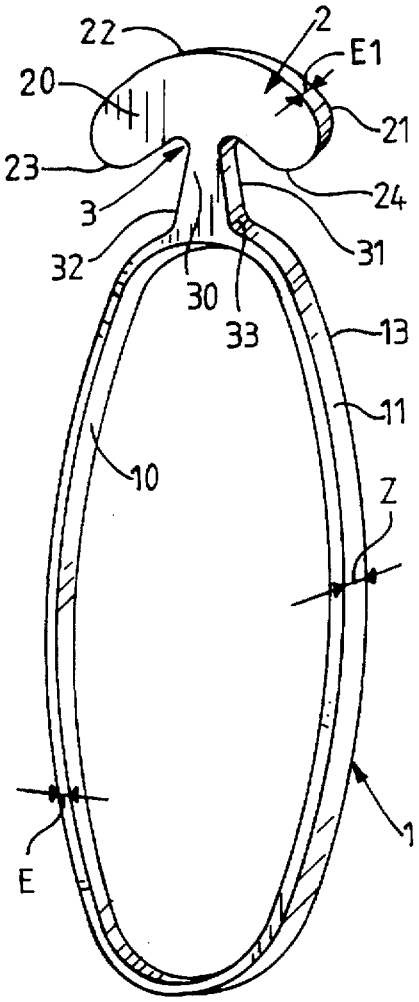
FIG. 1
FIG. 2
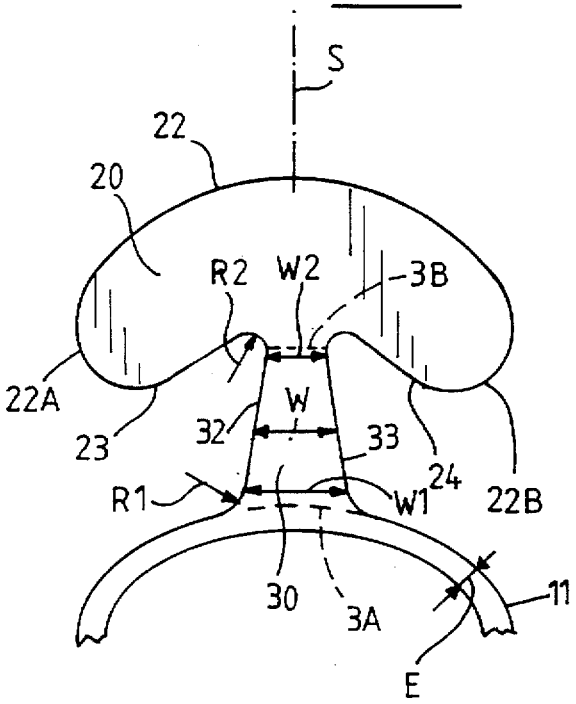
FIG. 3
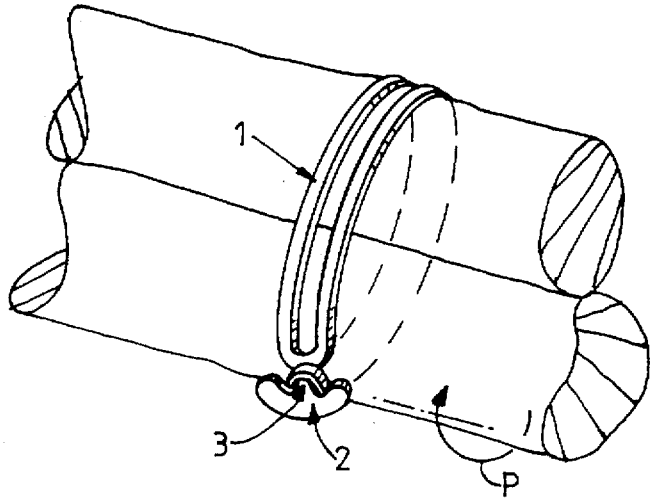

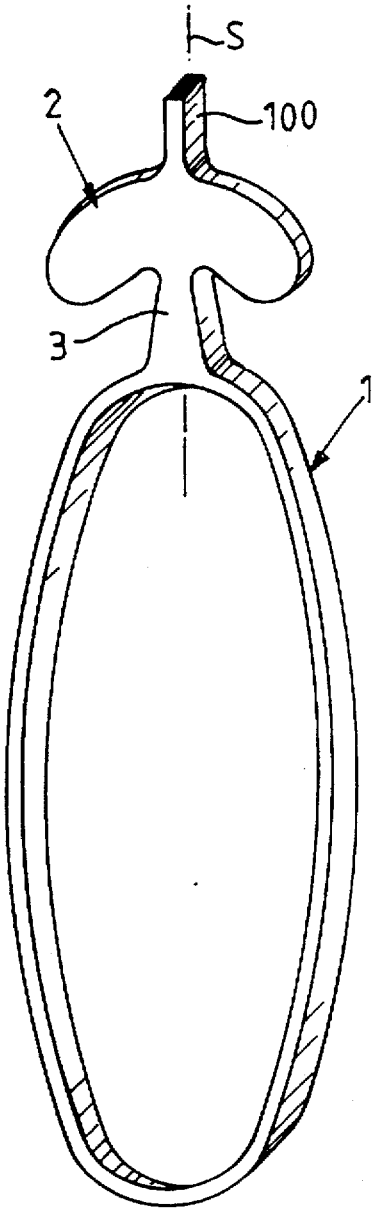
FIG. 7
FIG. 8
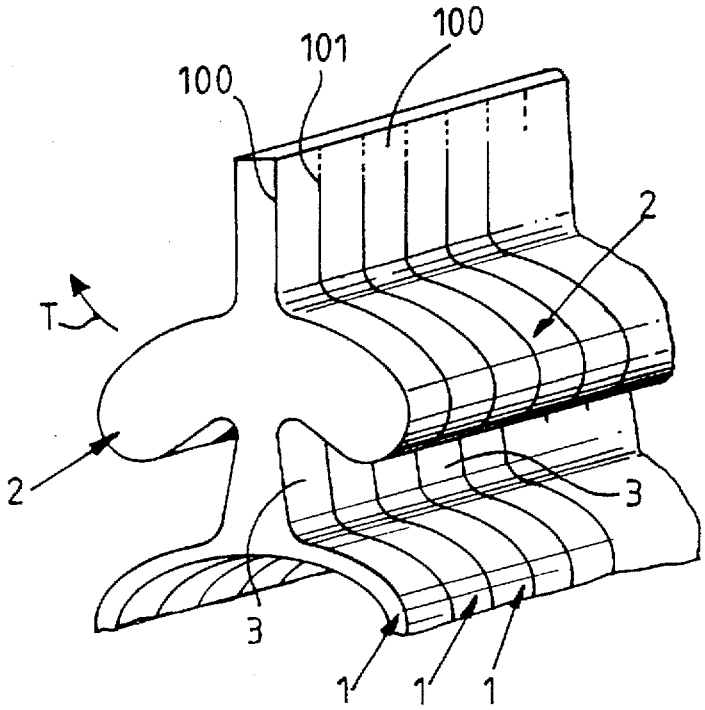

TYPING AND FASTENING DEVICE

FIELD OF THE INVENTION

The invention relates to a tying and fastening device suitable for fastening branches of trees to supports, vines to wires, roses to wires, without damaging the branches, the vines, the roses as well as the support.

THE PRIOR ART

A tying and fastening device for fastening vines and stems, such as grapes, roses, tomatoes, beans, . . . to wire or other supports is teached in U.S. Pat. No. 2,648,879. Said tying and fastening device comprises an endless band of elastic material, a knob and an intermediate neck portion.

In the device according to U.S. Pat. No. 2,648,879, the next portion is a weak point. Tests made by applicant have shown that, when fastening a branch of a tree to a wire by means such a device, a very high risk of breaking the neck portion adjacent to the endless band or adjacent to the knob exists, and that, after placing the device under tension for fastening a branch of a tree to a wire, the neck portion was quickly destroyed. Said device is therefore not suitable for tying and fastening safely branches of trees, vines to wire, etc The invention relates to a device solving this problem, i.e. a device having a neck portion which is no more the weak point of the device. Other advantages of the invention will also appear from the following description.

BRIEF DESCRIPTION OF THE INVENTION

The invention relates to a one piece rubber tying and fastening device comprising an endless band with an inner face and an outer face located between two lateral faces, a knob and a neck portion connecting the said knob to the outer face of the endless band. The said knob has (a1) two opposite lateral faces, (b1) an end substantially circular face extending between two end edges and between the said two lateral faces, and (c1) two intermediate faces extending between the said two opposite lateral faces of the knob and connecting the said end edges to the neck portion, while the neck portion has (a2) two opposite lateral faces and (b2) two opposite side faces connecting the outer face of the endless band to the intermediate faces of the knob, whereby the intermediate faces in the neighbourhood of the neck portion and the two side faces of the neck portion have a minimum bend radius of 0.5 mm, advantageously a bend radius of between 1 mm and 5 mm, and preferably a bend radius of between 1 mm and 3 mm. When placing such device for fastening a branch to a support (the knob being introduced in the loop of the endless band, i.e. the knob is thrust through the loop of the endless band), the breaking down the device at the neck portion can be prevented and the bend radius ensures that the pressure of the loop is essentially exerted on the part of the neck portion adjacent to the knob and on the intermediate faces of the knob. Said minimum bend radius ensures also a correct fastening preventing the knob to be pulled out of the loop. In fact, when fastening a branch of a tree to a support by means of a device of the invention, no or a lower pressure is exerted on a zone between the intermediate face of the knob and the side face of the neck portion.

According to a preferred embodiment, the neck portion has a variable width defined between its two opposite side faces, said width being maximum in the neighbourhood of the endless band. Preferably, said width is minimum in the neighbourhood of the knob. This ensures a correct position of the loop towards the knob. For example, the neck portion has a first end adjacent to the endless rubber band and a second end adjacent to the knob, the width of the neck portion progressively diminishing from said first end and said second end.

According to a specific embodiment, the endless band has a thickness of at least 1 mm and the neck portion has a first end adjacent to the endless rubber band and a second end adjacent to the knob, the width of the neck portion progressively diminishing from said first end and said second end. The width of the neck portion at said first end is advantageously greater than the double of the thickness of the endless band, while the width of the neck portion at said second end being greater than the thickness of the endless band.

According to preferred embodiments, in which the outer face of the endless band has a width and in which the neck portion has a width between its side faces or a width varying between a minimum width and a maximum width, the width or the minimum and maximum widths of the neck portion are comprised between 0.75×the width of the outer face of the endless band and 1.5×the width of the outer face of the endless band. In a specific embodiment, the width of the neck portion is constant and substantially equal to the width of the outer face of the endless band.

According to another possible embodiment, two grooves are defined between the intermediate faces of the knob and the side faces of the neck portion, said grooves having a curved shape with bend radius of at least 1 mm and having a depth of at least 2 mm.

The knob bears advantageously on its substantially circular face a rubber arm. Said arm extends preferably substantially in the symmetrical plane of the neck portion and the knob. Such an arm facilitates the placement of the knob in the loop of the endless band and the manipulation of the device whatever be the position of the knob. Such an arm can also be used for connecting together devices to be used.

According to a specific embodiment, the knob and the neck portion have a symmetrical plane, the intermediate faces of the knob have a part inclined with respect to the said symmetrical plane, an angle of between 30 and 75° being formed between each of said part and the symmetrical plane.

The invention relates therefore also to a plurality of one piece rubber devices linked together, each device comprising an endless band with an inner face and an outer face located between two lateral faces, a knob and a neck portion connecting the said knob to the outer face of the endless band, the said knob having (a1) two opposite lateral faces, (b1) an end substantially circular face extending between two end edges and between the said two lateral faces, (c1) an arm attached to said substantially circular face, and (d1) two intermediate faces extending between the said two opposite lateral faces of the knob and connecting the said end edges to the neck portion, while the neck portion has (a2) two opposite lateral faces and (b2) two opposite side faces connecting the outer face of the endless band to the intermediate faces of the knob, whereby the intermediate faces in the neighbourhood of the neck portion and the two side faces of the neck portion have a minimum bend radius of 0.5 mm, in which the arms of two adjacent one piece rubber devices are connected together, while their endless bands, neck portions and knobs are not connected together, whereby a cut extends between said arms from the knob, so that by tearing an one piece rubber device with respect to the other one piece rubber device, the arms of the said one piece rubber devices are separated the one from the other, whereby the said one piece rubber devices are separated the one from the other.

Further details and characteristics of the invention will appear from the following description in which reference is made to the attached drawings.

BRIEF DESCRIPTION OF THE DRAWINGS

FIG. 1 is a perspective view of a device of the invention;

FIG. 2 is a view of a detail of the neck portion of the device of the invention;

FIG. 3 is a view of the device of FIG. 1 used for fastening a branch to a support;

FIG. 7 is a perspective view of still another embodiment of a device of the invention, and FIG. 8 is a perspective view of a plurality of devices of FIG. 6 attached together.

DESCRIPTION OF PREFERRED EMBODIMENTS

Figure 4:
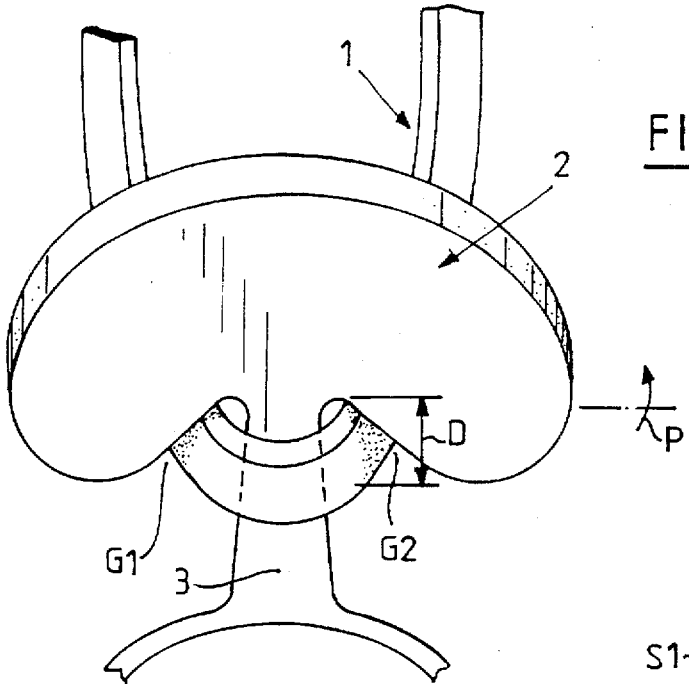
FIG. 4 is a view showing in detail the position of the loop with respect to the knob of the device of FIG. 3.

FIG. 1 shows a one piece rubber tying and fastening device comprising an endless band 1 with an inner face 10 and an outer face 11 located between two lateral faces 12,13, a knob 2 and a neck portion 3 connecting the said knob 2 to the outer face 11 of the endless band 1. The knob 2 has (a1) two opposite lateral faces 20,21, (b1) an end substantially circular face 22 extending between two end edges 22A,22B and between the said two lateral faces 20,21, and (c1) two intermediate faces 23,24 extending between the said two opposite lateral faces 20,21 of the knob 2 and connecting the said end edges 22A,22B to the neck portion, 3. The neck portion 3 has (a2) two opposite lateral faces 30,31 and (b2) two opposite side faces 32,33 connecting the outer face 11 of the endless band 1 to the intermediate faces 23,24 of the knob 2. The intermediate faces 23,24 in the neighbourhood of the neck portion 3 and the two side faces 32,33 of the neck portion 3 have a minimum bend radius of 0.5 mm. The bend radius R1 of the side faces 32,33 in the neighbourhood of the outer face 11 of the band 1 is about 3 mm, while the bend radius R2 of the portion of the faces 32,33 adjacent to the neck portion 3 is about 1 mm. The neck portion 3 extends from a first end 3A adjacent to the endless rubber band 1 to a second end 3B adjacent to the knob, the width W of the neck portion progressively diminishing from said first end 3A towards said second end 3B. The width W1 of the neck portion 3 at said first end 3A is greater than 3 times the thickness E of the endless band 1 (W1=3 to 4×E, for example), while the width W2 of the neck portion at said second end 3B is greater than 2 times the thickness E of the endless band (W2=2 to 3×E, for example). With respect to the width Z of the outer face 11, the width W1 is equal to about 1.5×Z, while the width W2 is equal to about Z.

The endless band 1 has a thickness E of at least 1 mm, for example 2 mm or even more.

Two grooves G1,G2 are defined between the intermediate faces of the knob and the side faces of the neck portion, said grooves having a curved shape with bend radius of at least 1 mm and having a depth D of at least 2 mm. When inserting the knob 2 and the neck portion 3 in the loop of the endless band, parts of the loop are engaged into said grooves G1,G2. Due to the variable width of the neck portion, the parts of the loop engaged in the said grooves G1,G2 are adjacent to the knob 2, whereby the inner face of the endless band contacts the neck portion as well as partly the intermediate faces 23,24 of the knob 2 and possibly a lateral face 20 or 21. A rotation P of the knob 2 with respect to the neck portion 3 then occurs. The fastening force due to the elastic band 1 is exerted by its inner face on the neck portion as well as on the intermediate faces 23,24. The knob 2 and the neck portion 3 have the same symmetrical plane S and have a thickness E1 corresponding to the width Z of the band 1.

Figure 5:
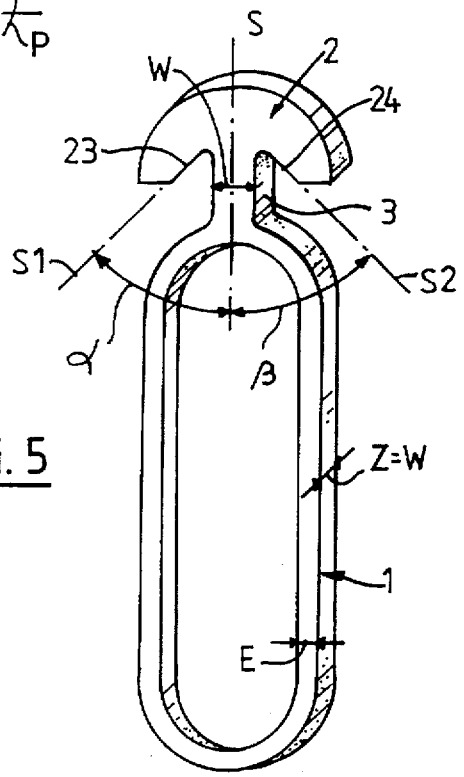
FIG. 5 is a perspective view of another device of the invention.
Figure 6:
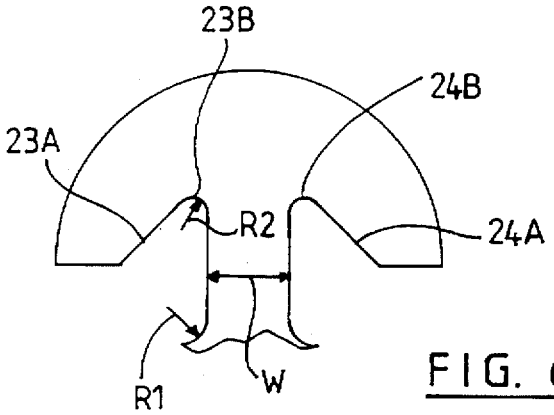
FIG. 6 is a detail view of the device shown in FIG. 5.

FIGS. 5 and 6 are views similar to FIGS. 1 and 2 of another embodiment. In this embodiment the neck portion has a constant width W equal to twice the thickness E of the end band 1. The intermediate faces 23, 24 of the knob have each a part 23A,24A extending in a plane S1,S2 forming an angle α,β of between 30 and 75°, preferably about 45 to 55°, with the symmetrical plane S of the knob and the neck portion. The said angles α,β can be equal or different. By means of such angle or inclination of the said parts 23A, 24A, which are adjacent to the parts 23B,24B with a bend radius R2 of at least 1 mm connecting said parts 23A,24A to the neck portion 3, the elastic force is partly exerted by the inner face of the band 1 on the parts 23A,24A of the knob 2. The thickness E of the band 1 is advantageously greater than twice the bend radius of the parts 23B,24B so as to prevent or limit the pressure contact of the band 1 with the parts 23B, 24B when the knob 2 and the neck portion are inserted in the loop of the band 1.

It is obvious that two or more fastening devices can be connected together by means of their knobs so as to form a larger fastening means.

The fastening means shown in FIG. 7 is similar to the fastening means of FIG. 5, except that the knob is provided on its circular face with an arm 100 extending in the symmetrical plane S of the knob and the neck portion. Said arm 100 facilitates the manipulation of the fastening means. The said arm can also be used for linking together adjacent fastening devices, before using them for fastening a branch to a support.

FIG. 8 shows a plurality of one piece rubber devices linked together, each device comprising an endless band 1 with an inner face and an outer face 11 located between two lateral faces, a knob 2 and a neck portion 3 connecting the said knob to the outer face of the endless band, the said knob having (a1) two opposite lateral faces, (b1) an end substantially circular face extending between two end edges and between the said two lateral faces, (c1) an arm attached to said substantially circular face, and (d1) two intermediate faces extending between the said two opposite lateral faces of the knob and connecting the said end edges to the neck portion, while the neck portion has (a2) two opposite lateral faces and (b2) two opposite side faces connecting the outer face of the endless band to the intermediate faces of the knob, whereby the intermediate faces in the neighbourhood of the neck portion and the two side faces of the neck portion have a minimum bend radius of 0.5 mm, in which the arms 100 of two adjacent one piece rubber devices are connected together, while their endless bands, neck portions and knobs are not connected together, whereby a cut 101 extends partly between said arms 100 from the knob 2, so that by tearing (force T) an one piece rubber device X with respect to the other one piece rubber device Y, the arms 100 of the said one piece rubber devices are separated the one from the other, whereby the said one piece rubber devices are separated the one from the other. The cut 101 facilitates the separation of the rubber devices the one from the other. Such an assembly of rubber devices is advantageous for the user, as he can take the rubber devices one by one, without any risk of lost of rubber device on the ground. In case the endless rubber band is big enough, the arm of the user can act as support for the said assembly of rubber devices.

What I claim is:

1. A one piece rubber tying and fastening device comprising an endless band with an inner face and an outer face located between two lateral faces, a knob and a neck portion connecting the said knob to the outer face of the endless band, the said knob having (a1) two opposite lateral faces, (b1) an end substantially circular face extending between two end edges and between the said two lateral faces, and (c1) two intermediate faces extending between the said two opposite lateral faces of the knob and connecting the said end edges to the neck portion, while the neck portion has (a2) two opposite lateral faces and (b2) two opposite side faces connecting the outer face of the endless band to the intermediate faces of the knob, whereby the intermediate faces in the neighbourhood of the neck portion and the two side faces of the neck portion have a minimum bend radius of 0.5 mm.

2. The one piece rubber device of claim 1, in which the intermediate faces in the neighbourhood of the neck portion and the two side faces of the neck portion have a bend radius of between 1 mm and 5 mm.

3. The one piece rubber device of claim 1, in which the intermediate faces in the neighbourhood of the neck portion and the two side faces of the neck portion have a bend radius of between 1 mm and 3 mm.

4. The one piece rubber device of claim 1, in which the neck portion has a variable width defined between its two opposite side faces, said width being maximum in the neighbourhood of the endless band.

5. The one piece rubber device of claim 4, in which the neck portion has a variable width defined between its two opposite side faces, said width being minimum in the neighbourhood of the knob.

6. The one piece rubber device of claim 4, in which the neck portion has a first end adjacent to the endless rubber band and a second end adjacent to the knob, the width of the neck portion progressively diminishing from said first end and said second end.

7. The one piece rubber device of claim 1, in which the endless band has a thickness of at least 1 mm, while the neck portion has a width which is at least greater than the said thickness of the endless band.

8. The one piece rubber device of claim 1, in which the endless band has a thickness of at least 1 mm, in which the neck portion has a first end adjacent to the endless rubber band and a second end adjacent to the knob, the width of the neck portion progressively diminishing from said first end and said second end, the width of the neck portion at said first end being greater than the double of the thickness of the endless band, while the width of the neck portion at said second end is greater than the thickness of the endless band.

9. The one piece rubber device of claim 1, in which two grooves are defined between the intermediate faces of the knob and the side faces of the neck portion, said grooves having a curved shape with bend radius of at least 1 mm and having a depth of at least 2 mm.

10. The one piece rubber device of claim 1, in which the knob bears on its substantially circular face a rubber arm.

11. The one piece rubber device of claim 1, in which the neck portion and the knob have a same symmetrical plane, in which the knob bears on its substantially circular face a rubber arm, said arm extending substantially in said symmetrical plane.

12. The one piece rubber device of claim 1, in which the knob and the neck portion have a symmetrical plane, in which the intermediate faces of the knob have a part inclined with respect to the said symmetrical plane, an angle of between 30 and 75° being formed between each of said part and the symmetrical plane.

13. The one piece rubber device of claim 1, in which the outer face of the endless band has a width, in which the neck portion has a width between its side faces, and in which the width of the neck portion is comprised between 0.75× the width of the outer face of the endless band and 1.5× the width of the outer face of the endless band.

14. The one piece rubber device of claim 1, in which the outer face of the endless band has a width, in which the neck portion has a variable width between its side faces, and in which the width of the neck portion varies between a minimum width and a maximum width, said minimum width and maximum width being comprised between 0.75× the width of the outer face of the endless band and 1.5× the width of the outer face of the endless band.

15. A plurality of one piece rubber devices linked together, each device comprising an endless band with an inner face and an outer face located between two lateral faces, a knob and a neck portion connecting the said knob to the outer face of the endless band, the said knob having (a1) two opposite lateral faces, (b1) an end substantially circular face extending between two end edges and between the said two lateral faces, (c1) an arm attached to said substantially circular face, and (d1) two intermediate faces extending between the said two opposite lateral faces of the knob and connecting the said end edges to the neck portion, while the neck portion has (a2) two opposite lateral faces and (b2) two opposite side faces connecting the outer face of the endless band to the intermediate faces of the knob, whereby the intermediate faces in the neighbourhood of the neck portion and the two side faces of the neck portion have a minimum bend radius of 0.5 mm, in which the arms of two adjacent one piece rubber devices are connected together, while their endless bands, neck portions and knobs are not connected together, whereby a cut extends between said arms from the knob, so that by tearing an one piece rubber device with respect to the other one piece rubber device, the arms of the said one piece rubber devices are separated the one from the other, whereby the said one piece rubber devices are separated the one from the other.

* * * * *